United States Patent [19]

Nielsen

[11] 4,084,413

[45] Apr. 18, 1978

[54] APPARATUS FOR LIQUID TREATMENT AND DRYING OF BOBBINS

[75] Inventor: Hans Børge Nielsen, Reinhach, Switzerland

[73] Assignee: Vald. Henriksen A/S, Denmark

[21] Appl. No.: 730,240

[22] Filed: Oct. 7, 1976

[30] Foreign Application Priority Data

| | | |
|---|---|---|
| Oct. 8, 1975 | Denmark | 4531/75 |
| Aug. 3, 1976 | Denmark | 3498/76 |

[51] Int. Cl.[2] ..... D06B 5/18

[52] U.S. Cl. ..... 68/189; 34/104

[58] Field of Search ..... 68/189, 198, 20, 150; 8/155.1; 34/104

[56] References Cited

U.S. PATENT DOCUMENTS

| | | | |
|---|---|---|---|
| 764,966 | 7/1904 | Venter | 68/189 |
| 773,378 | 10/1904 | Detre | 68/189 |
| 1,173,160 | 2/1916 | Barker | 68/189 |
| 2,509,282 | 5/1950 | Woodruff | 68/189 |
| 3,631,691 | 1/1972 | Karrer et al. | 68/189 X |
| 3,638,458 | 2/1972 | Librecht | 68/189 |

FOREIGN PATENT DOCUMENTS

| | | | |
|---|---|---|---|
| 841,122 | 2/1939 | France | 8/155.1 |
| 333,677 | 9/1903 | France | 68/189 |
| 333,676 | 4/1904 | France | 68/189 |
| 165,173 | 11/1905 | Germany | 68/189 |
| 483,856 | 4/1938 | United Kingdom | 68/189 |

*Primary Examiner*—Philip R. Coe

*Attorney, Agent, or Firm*—Cushman, Darby & Cushman

[57] ABSTRACT

An apparatus for liquid treatment and drying of bobbins having a cylindrical container and an insert with one or more distribution chambers from which horizontal distributor pipes extend in parallel.

2 Claims, 6 Drawing Figures

APPARATUS FOR LIQUID TREATMENT AND DRYING OF BOBBINS

Figure 1:
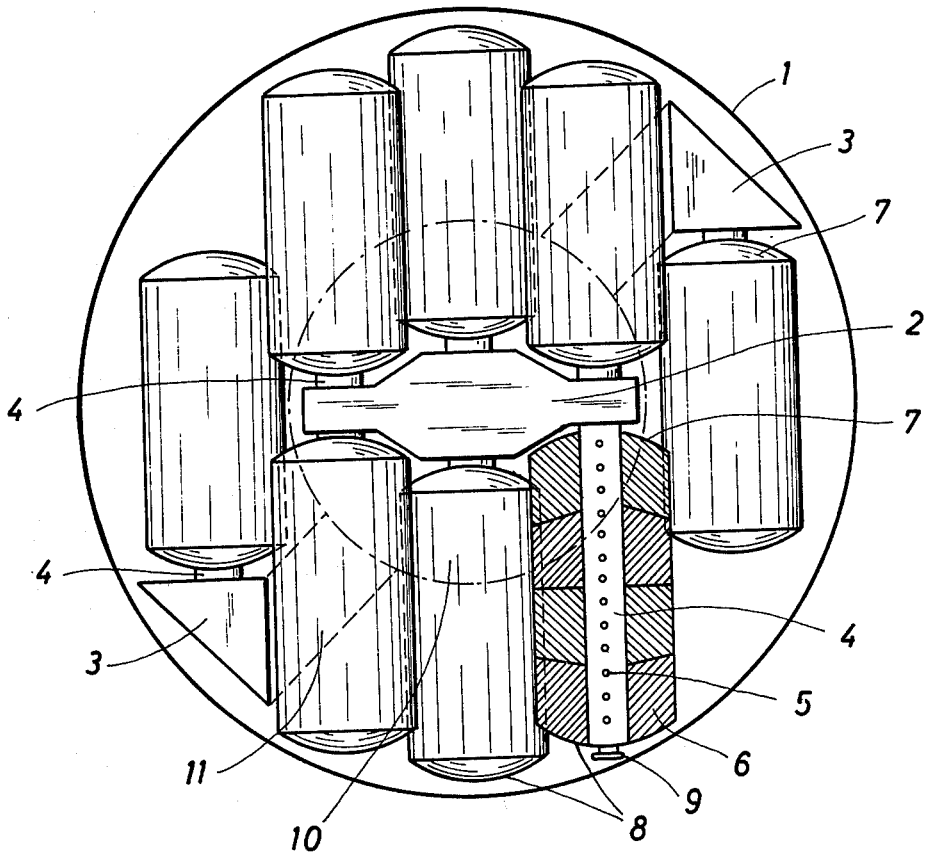

The present invention relates to an apparatus for liquid treatment and drying of bobbins.

The development in the textile industry during recent years has implied that the troublesome procedure by treatment of yarn in skeins (hank yarn) has been replaced by treatment of yarn in bobbins. This has, however, caused several difficulties when it is a question of treating soft bobbins, i.e. bobbins of soft, voluminous yarn, since these bobbins are very little deformation-resistant in the longitudinal direction. Furthermore, it cannot be avoided that the bobbins when arranged on vertical distributor pipes are deformed under the influence of gravity, the lowest bobbins being most deformed. This in turn causes a heterogeneous penetrating flow of liquid by wet treatment or of air by drying, and this leads for instance to a heterogeneous shade after dyeing or to a heterogeneous moisture content after drying.

These drawbacks may, of course, be relieved by using apparatuses comprising an insert with horizontal distributor pipes, and apparatuses provided with a quadrangular cross section and horizontal distributor pipes are in fact already known. However, such apparatuses have a limited field of application because their manufacture as autoclave for higher pressures is too expensive.

In order to be constructed as an autoclave without excessive costs the apparatus must comprise a cylindrical container. The known apparatuses comprising a cylindrical container have, however, essential drawbacks, too. A horizontal cylindrical container requires, for instance, much floorage, and it is a further drawback that the container must be emptied of liquid before the insert can be removed or inspected. For this reason it is preferred for dyeing of soft bobbins to use apparatuses with a vertical cylindrical container, because such apparatuses take up less floorage, because the insert can be removed by hoisting without necessitating an emptying of the container of liquid, and because such apparatuses are universally applicable, e.g. also for liquid treatment of yarn in skeins, tops, loose material, and hard bobbins, merely by an exchange of inserts.

A single apparatus is known comprising a vertical, cylindrical container and horizontal distributor pipes on which the bobbins may be arranged. This apparatus comprises a distribution chamber in the form of a centrally located vertical pipe from which the distributor pipes extend radially. This apparatus has essential drawbacks, too, of which the most important is, that the container volume is very badly utilized, since the bobbins may be close to one another only near the centre of the container, whereas large unutilized spaces are left near the container wall.

The present invention relates to an apparatus for liquid treatment and drying of bobbins comprising a vertical, cylindrical container having a removable insert with horizontal distributor pipes on which the bobbins may be arranged, said apparatus furthermore being provided with means for circulating liquid or air through the distributor pipes.

The apparatus according to the invention is characterized in that the insert comprises one or more distribution chambers from which the distributor pipes extend in parallel.

In this manner a better utilization of the container volume is obtained, and at the same time it is made possible to mechanize the mounting of the bobbins.

Depending on the bobbin sizes various embodiments of the apparatus offering the best utilization of the container volume are possible. A particularly suitable embodiment is characterized in that the insert comprises a diametrally arranged, oblong distribution chamber and two or more distribution chambers located along the container wall, and that the distribution pipes are of equal length. In this manner the columns of bobbin are of equal length, which is advantageous for a uniform treatment of the yarn.

A second embodiment of the apparatus particularly suitable for the mechanizing of the mounting of the bobbins is characterized in that the insert comprises a single distribution chamber located along the container wall, from which chamber the distributor pipes extend in the same direction.

A third embodiment of the apparatus offering a particularly high degree of utilization of the container volume is characterized in that the insert comprises a diametrally arranged, oblong distribution chamber and two or more distribution chambers located along the container wall, and that the distributor pipes are of different lengths.

The distribution chambers may be polygonal, which may facilitate the connecting of the distributor pipes in such manner that the best possible filling up of the container volume with bobbin columns is obtained. Polygonal distribution chambers may also be a constructional advantage, since usually the distribution chambers must have a shape differing considerably from the tubular (cylindrical) shape by having an oblong cross section.

The distribution chambers may also have rounded shapes or combinations of angular and rounded shapes, since such shapes may offer manufacturing advantages and advantages in strength compared with polygonal distribution chambers.

The invention is further illustrated in the drawing, in which

Figure 2:
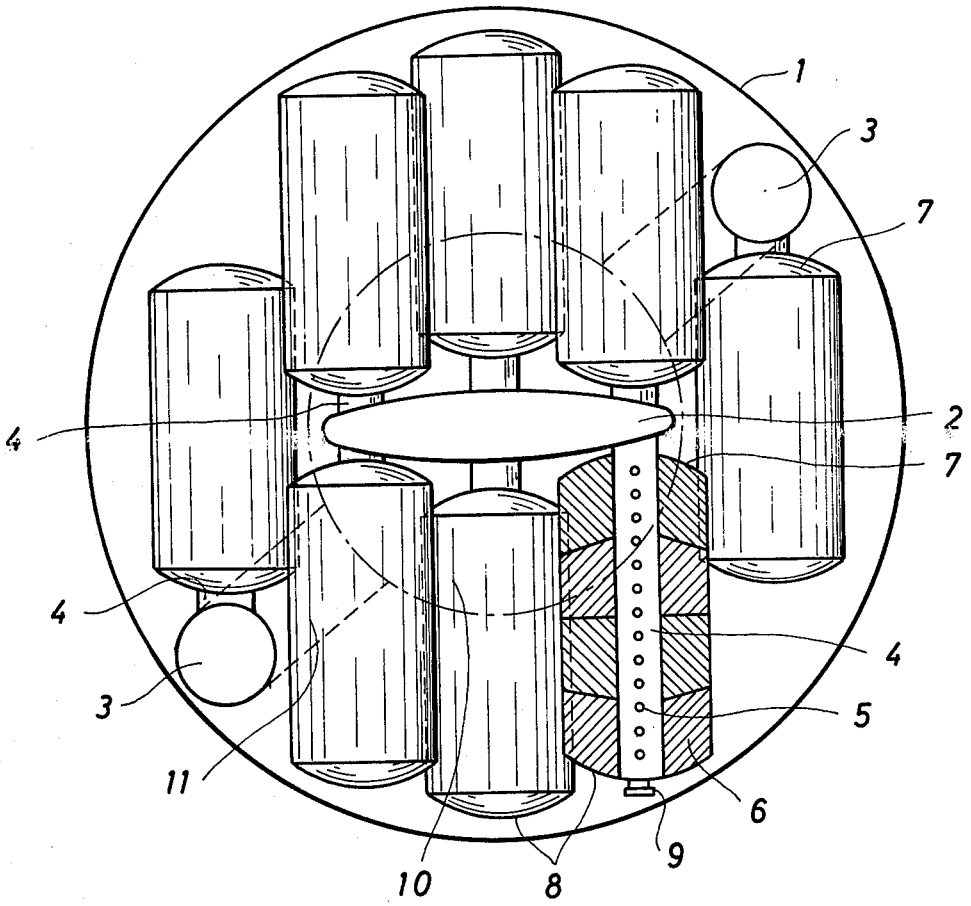
Figure 3:
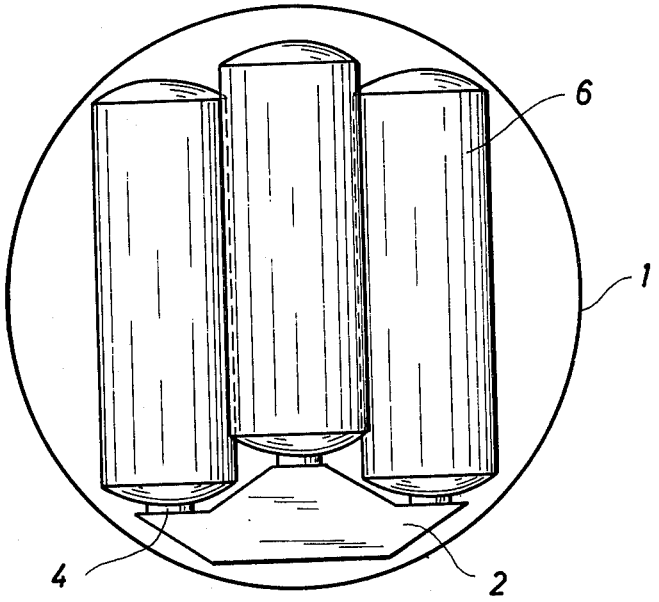
Figure 4:
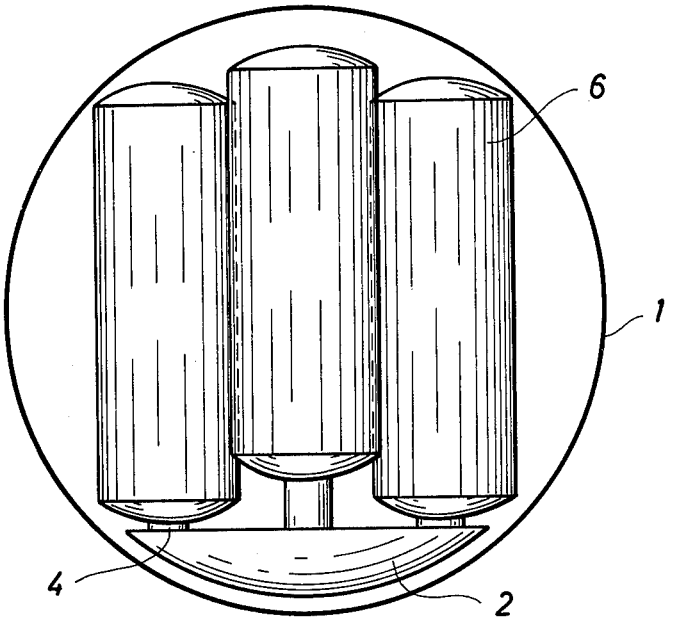
Figure 5:
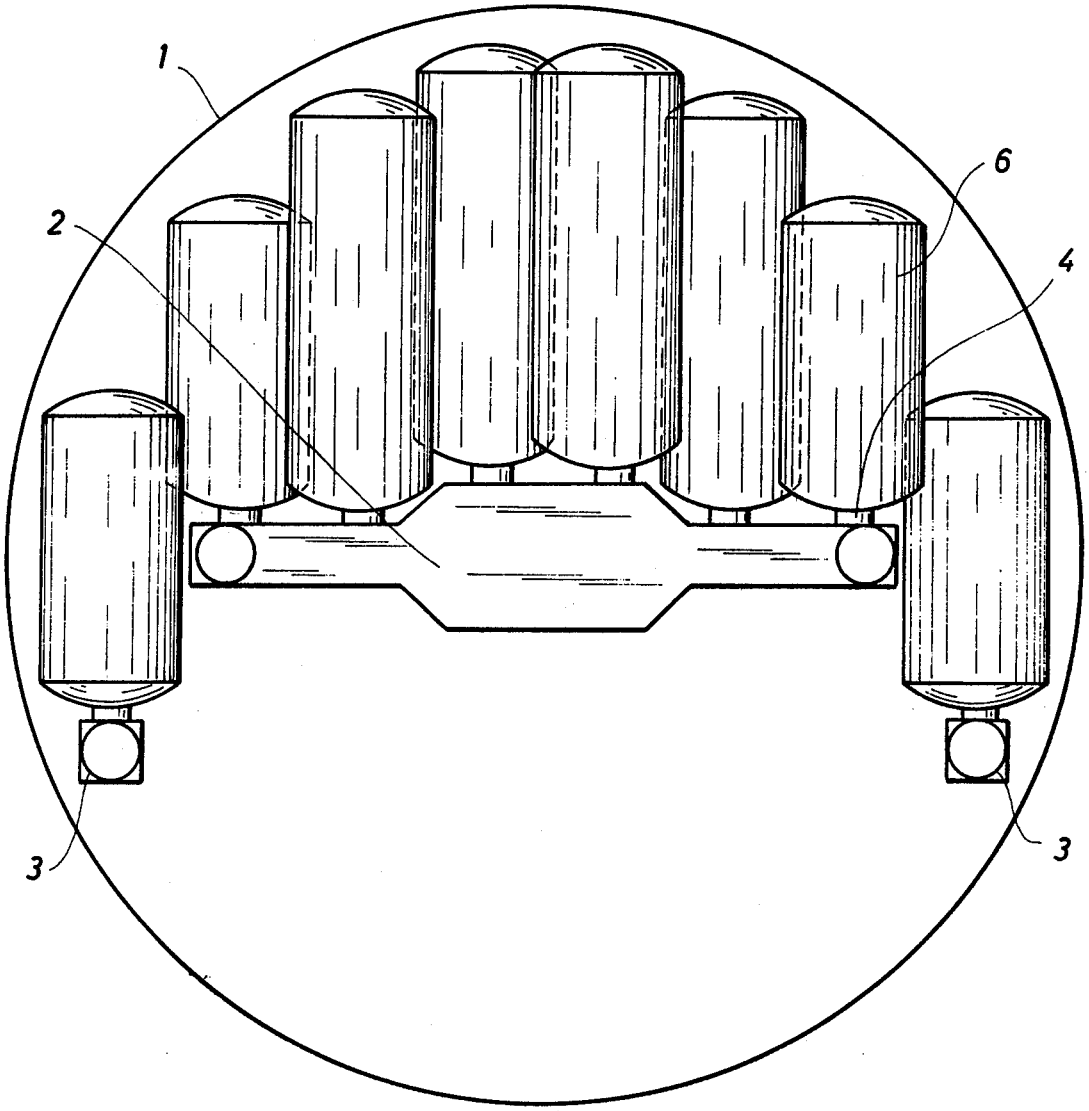
Figure 6:
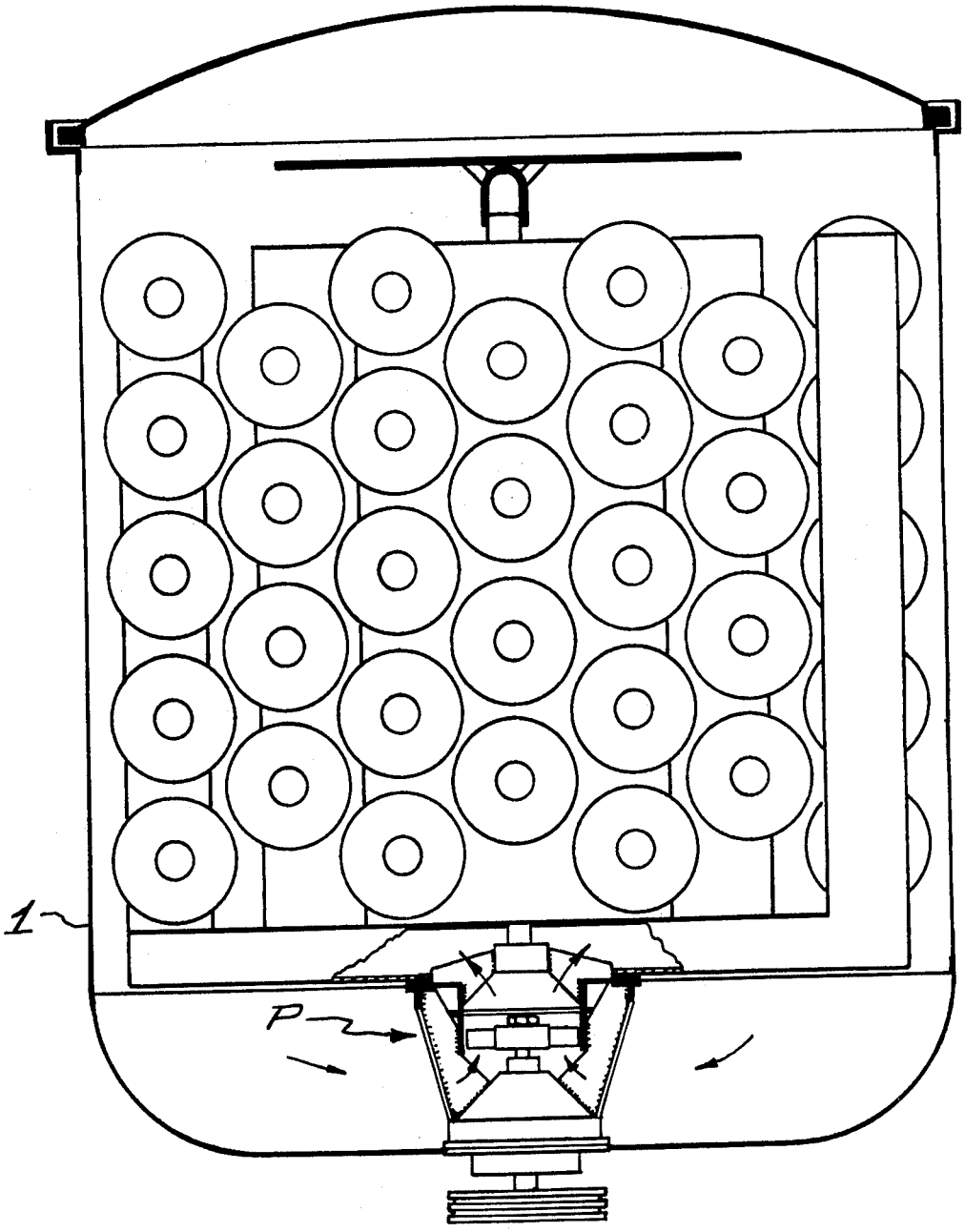

FIG. 1 is a horizontal sectional view of an embodiment of the apparatus according to the invention with bobbins of yarn mounted therein, and a sectional view of one of the bobbin columns, FIG. 2 is a horizontal sectional view of a similar embodiment of the apparatus according to the invention in which the distribution chambers have a different shape, FIG. 3 is a horizontal sectional view of a second embodiment of the apparatus, FIG. 4 is a horizontal sectional view of a similar embodiment of the apparatus according to the invention in which the distribution chambers have a different shape, FIG. 5 is a horizontal sectional view of a third embodiment of an apparatus, FIG. 6 is a diagrammatic vertical sectional view of one embodiment of the present invention showing pump means at the bottom of the container.

FIG. 1 shows a cylindrical container 1, in which an insert is located comprising an oblong, polygonal distribution chamber 2 diametrally arranged relative to the container and two triangular distribution chambers 3 along the container wall. Liquid or air is supplied up into these distribution chambers by means of a pump or a propeller, generally designated by the letter P in FIG. 6, and shown as being in the bottom of the container, flows thence into parallel distributor pipes 4 through apertures 5 therein, and then out into the bobbins 6 whereupon it recirculates to the pump P through the free space in the container. Each bobbin column comprises in this case four bobbins. The bobbins are held in place on the distributor pipes by means of a bottom cap 7 and a top cap 8. 9 is a lock clamp locking the top cap 8. The bottom cap 7 and the top cap 8 are manufactured either as ball segments as illustrated or as a conical surface. These shapes permit the illustrated polygonal shape of the central distribution chamber 2. 10 is a terminal chamber forming a liquid-tight closure with the central distribution chamber 2 at the top and at the bottom forming a liquid-tight closure with the inlet pipe. 11 is a connecting pipe between the terminal chamber 10 and the two distribution chambers 3. When a central distribution chamber 2 thus feeds six bobbin columns, three on each side of the chamber, and two distribution chambers 3 feed their respective bobbin columns located in the circle segments arising between the outermost of the six bobbin columns and the container wall, good utilization of the container cross section is obtained. The structure illustrated permits a simple mechanizing of the mounting of the bobbins, since these bobbins are to be inserted in parallel in opposite directions.

In FIG. 2, 1 is the cylindrical container, in which an insert is arranged comprising an oblong, oval distribution chamber 2 diametrally arranged relative to the container and two circular distribution chambers 3 at the container wall. Otherwise, this embodiment corresponds exactly to the embodiment illustrated in FIG. 1.

In the embodiment illustrated in FIG. 3 a single polygonal distribution chamber 2 is located adjacent the container wall 1, and from this distribution chamber three parallel distributor pipes 4 extend in the same direction, the bobbin columns 6 being arranged on these distributor pipes. This embodiment is particularly suitable for mechanizing of the mounting of the bobbins, since all of these bobbins are inserted on the distributor pipes from the same side.

FIG. 4 shows an embodiment corresponding to the embodiment illustrated in FIG. 3. In this embodiment the distribution chamber has a combination of angular and rounded shapes, the illustrated cross section being limited by a straight line and a circular curve.

FIG. 5 shows an embodiment in which not all the distributor pipes and consequently the bobbin columns are of equal lengths. The apparatus comprises a container 1, a diametrally arranged, oblong, polygonal distribution chamber 2 and two peripheral distribution chambers 3. The treatment liquid or the air is fed from these distribution chambers to the bobbins 6 through parallel distribution pipes 4, the lengths of which are so that the bobbins when mounted on the distributor pipes offer the most ideal filling of the container volume and consequently the best utilization of the apparatus.

I claim:

1. An apparatus for liquid treatment and drying of bobbins comprising a vertical, cylindrical container having a removable insert with horizontal distributor pipes on which the bobbins may be arranged, said apparatus furthermore being provided with means for circulating liquid or air through the distributor pipes, characterized in that the insert comprises a diametrically arranged, oblong distribution chamber and two or more distribution chambers located along the container wall, from which distribution chamber distributor pipes of equal length extend in parallel.

2. An apparatus for liquid treatment and drying of bobbins comprising a vertical, cylindrical container having a removable insert with horizontal distributor pipes on which the bobbins may be arranged, said apparatus furthermore being provided with means for circulating liquid or air through the distributor pipes, characterized in that the insert comprises a diametrically arranged, oblong distribution chamber and two or more distribution chambers located along the container wall, from which distribution chamber distributor pipes of different lengths extend in parallel.

* * * * *